US008888322B2

(12) United States Patent
Alfier et al.

(10) Patent No.: US 8,888,322 B2
(45) Date of Patent: Nov. 18, 2014

(54) REFLECTOR FOR LIGHT SOURCES AND LIGHT SOURCE DEVICE

(71) Applicant: OSRAM AG, Munich (DE)

(72) Inventors: Alberto Alfier, Vedelago (IT); Simone Capeleto, Padua (IT); Dina Pasqualini, Udine (IT)

(73) Assignee: OSRAM GmbH, Munich (DE)

( * ) Notice: Subject to any disclaimer, the term of this patent is extended or adjusted under 35 U.S.C. 154(b) by 221 days.

(21) Appl. No.: 13/650,144

(22) Filed: Oct. 12, 2012

(65) Prior Publication Data

US 2013/0094222 A1 Apr. 18, 2013

(30) Foreign Application Priority Data

Oct. 14, 2011 (IT) ..... TO2011A0920

(51) Int. Cl.

| | |
|---|---|
| ***F21V 1/00*** | (2006.01) |
| ***F21V 11/00*** | (2006.01) |
| ***F21V 17/02*** | (2006.01) |
| ***F21V 7/00*** | (2006.01) |
| ***F21V 14/04*** | (2006.01) |
| *F21V 7/06* | (2006.01) |
| *F21Y 101/02* | (2006.01) |
| *F21Y 103/00* | (2006.01) |
| *F21Y 105/00* | (2006.01) |
| *F21V 7/22* | (2006.01) |

(52) U.S. Cl.

CPC . *F21V 14/04* (2013.01); *F21V 7/06* (2013.01); *F21V 17/02* (2013.01); *F21Y 2101/02* (2013.01); *F21Y 2103/003* (2013.01); *F21V 7/0083* (2013.01); *F21Y 2105/001* (2013.01); *F21V 7/22* (2013.01)

USPC ..... 362/238; 362/241; 362/249.03; 362/277; 362/346; 362/449

(58) Field of Classification Search

USPC ..... 362/238, 249.02–249.03, 277, 296.01, 362/306, 341, 346, 433, 449–450

See application file for complete search history.

(56) References Cited

U.S. PATENT DOCUMENTS

| | | | |
|---|---|---|---|
| 5,772,302 | A | 6/1998 | Ishikawa et al. |
| 2009/0231856 | A1 | 9/2009 | Householder et al. |

FOREIGN PATENT DOCUMENTS

| | | | |
|---|---|---|---|
| DE | 444187 | C | 5/1927 |

*Primary Examiner* — Jason Moon Han

(57) ABSTRACT

A reflector for light radiation sources, the reflector taking the form, for example, of a cup centered around a main axis with a bottom opening for a source of light radiation, the reflector including a cup-shaped base portion extending from the bottom opening to an outer rim, and an annular portion surrounding the outer rim. The annular portion may be telescopically coupled to the base portion and may be moveable with respect to the base portion along the main axis in order to vary the length over which the annular portion extends along the main axis with respect to the outer rim of the base portion.

2 Claims, 3 Drawing Sheets

REFLECTOR FOR LIGHT SOURCES AND LIGHT SOURCE DEVICE

CROSS-REFERENCE TO RELATED APPLICATION

This application claims priority to Italian Patent Application Serial No. TO2011A000920, which was filed Oct. 14, 2011, and is incorporated herein by reference in its entirety.

TECHNICAL FIELD

Various embodiments relate to reflectors for sources of light radiation. More particularly, various embodiments relate to reflectors usable in conjunction with LED sources of light radiation.

BACKGROUND

In the lighting source commercial sector, for example for lighting sources of the "spot" type used for indoor lighting application, the need can arise to be able to vary the configuration of the light beam emitted from a lighting source.

For example, in the case of LED lighting sources, it is possible to modify the configuration of the light beam emitted from the source by making use of reflectors and offering the user the possibility of choosing between different types of reflectors and of adopting for the installation the type of reflector which forms the desired configuration of illuminating beam.

The drawback of this type of solution is that it reduces flexibility: if the need or the wish arises to modify the configuration of the illuminating beam, the user is obliged to remove the old reflector and to provide a new reflector.

In this respect, the fact will be taken into account that the lighting sources in question are often used in arrays with corresponding (secondary) reflectors mounted on a common optical element normally fabricated in a single piece. In this case, the change of the configuration of illuminating beam requires all the reflectors to be changed, which can comprise drawbacks, for example in terms of cost.

SUMMARY

According to aspects of this disclosure, a reflector and a corresponding device is provided having the features claimed specifically in the claims that follow.

The claims form an integral part of the technical teaching presented here in relation to the invention.

Various embodiments, for example, allow the beam of radiation from a source of light radiation to be modified (and in particular adjusted) without having to change the reflector. The aforementioned adjustment action may be carried out in the case of an array of light sources operating simultaneously on all the sources of the array.

In various embodiments, it is possible to adjust the beam of radiation by means of a reflector, for example made of aluminum, without having to change the relevant optics but by simply displacing two component parts with respect to one another; this offers an enhanced flexibility for the end user and leads to a less costly solution.

Due to the relative slide positioning of the two parts of the reflector, it is possible to provide a high level of mechanical rigidity and of positioning accuracy with the possibility of using molded plastic members, for example in the form of a single piece of molded plastic material which incorporates within it the mobile parts of the reflectors associated with a plurality of light sources disposed in an array.

In various further embodiments, it is possible to act simultaneously on all the reflectors associated with an array of light sources, for example LED sources, with the possibility of activating an action for adjusting all the light sources of the array by acting on a single element.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DETAILED DESCRIPTION

In the following description various specific details are illustrated aimed at a deeper understanding of the embodiments. The embodiments may not comprise one or more of the specific details, or with other methods, components, materials, etc. In other cases, known structures, materials or operations are not shown or described in detail in order to avoid obscuring the various aspects of the embodiments.

The reference to "one embodiment" in the scope of this description is to indicate that a particular configuration, structure or feature described in relation to the embodiment is comprised within at least one embodiment. Thus, phrases such as "in one embodiment", potentially appearing in various places in this description, do not necessarily refer to the same embodiment. Furthermore, particular configurations, structures or features can be combined in any appropriate manner in one or more embodiments.

The references used here are only for convenience and do not therefore define the scope of protection or the range of application of the embodiments.

In the figures, the reference 10 indicates the entirety of a reflector for a source of light radiation capable of being constructed, for example, from an LED source of light radiation. Such a light source is only shown schematically in FIG. 2 and does not, per se, constitute part of the embodiments.

Figure 1:
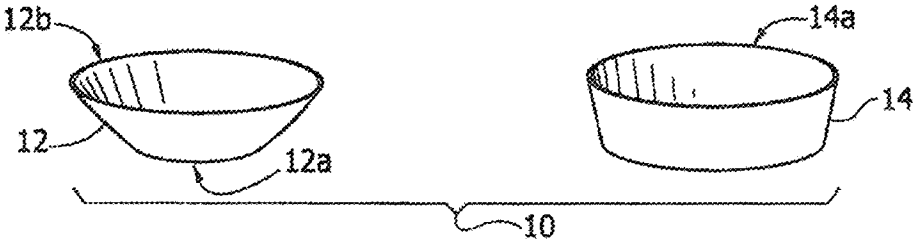
FIG. 1 illustrates the component parts of one embodiment.
Figure 2:
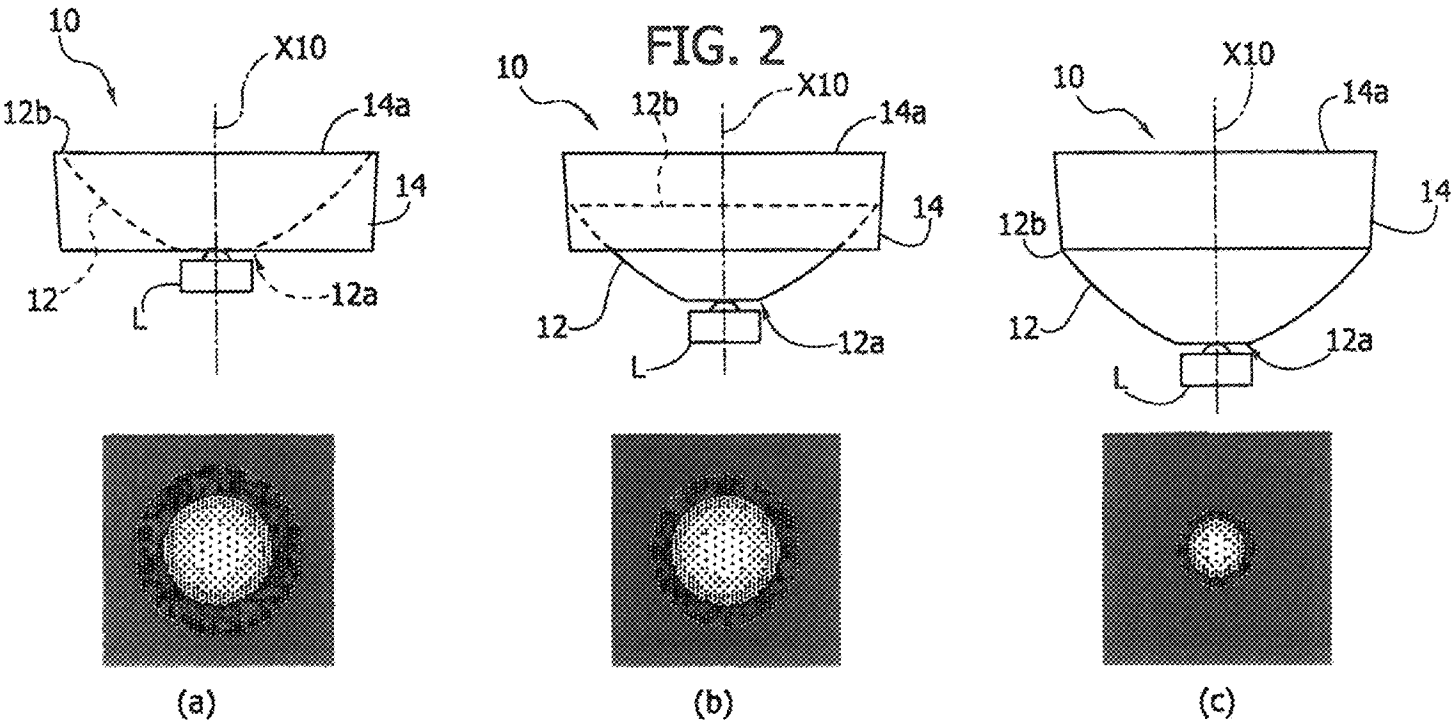
FIG. 2 is a schematic representation illustrating various conditions of operation of an embodiment.

Accordingly, as is better appreciated for example in the part (c) of FIG. 2, the reflector 10 takes the overall form of a pan base or cup centered around a main axis X10 that, in various embodiments, may be taken to correspond to the main axis of the emission diagram of the flux of light radiated from the source L.

In various embodiments the reflector 10 can comprise two parts:

- a cup-shaped base portion 12, for example with a parabolic surface, extending from a bottom opening 12*a* (to which in use the light source L is presented) to an outer rim 12*b*, and
- an annular portion 14 fitted around the base portion 12 so as to surround the outer rim 12*b*.

As can be appreciated from the observation of the three parts of FIG. 2, the annular portion 14 is telescopically coupled to the base portion 12. The two portions 12 and 14 are thus mutually moveable with respect to one another along the axis X10.

This relative movement means that the annular portion 14 may be displaced with respect to the base portion 12 along the axis X10 so as to be able to selectively vary the length of the annular portion 14 which extends beyond the outer rim 12*a* of the base portion 12.

In particular, in the condition shown in FIG. 2(*a*), the annular portion 14 is located in a retracted position such that the distal rim 14*a* (distal rim is understood to mean the rim furthest from the opening 12*a* where the light source L is presented) of the annular portion 14 is practically aligned with the outer rim 12*b* of the base portion 12.

Under such conditions, the radiation emitted from the source L "sees" in practice only the base portion 12 of the reflector 10 and the total light beam emitted from the light source L/reflector assembly 10 may exhibit, for example, the aspect of a broadened spot shown schematically in the lower portion of the part (a) of FIG. 2.

In practice, under such conditions, the length of the annular portion 14 which extends past the outer rim 12*b* of the base portion 12 is equal to zero.

The part (b) of FIG. 2 illustrates a condition of operation in which the annular portion 14 of the reflector 10 is made to move in the direction of the axis X10 in such a manner that the annular portion 14 of the reflector 10 protrudes over about half of its length (or height, in other words) beyond the outer rim 12*b* of the base portion 12.

The passage from the condition shown in the part (a) to the part (b) of FIG. 2—which passage can naturally occur via the continuum of intermediate positions—can produce a constriction/concentration of the light beam emitted from the source L/reflector assembly 10 as is shown schematically in the lower portion of the part (b) of FIG. 2.

The aforementioned forward movement of the annular portion 14 with respect to the base portion 12 can continue (once again via the continuum of the intermediate positions) to arrive at the condition shown in the part (c) of FIG. 2, in which the annular portion 10 protrudes over a length practically equal to the whole of its height beyond the outer rim 12*b* of the base portion.

Under such adjustment conditions, a further constriction/concentration of the light beam emitted from the source L/reflector assembly 10 can be obtained such as is shown schematically in the lower portion of the part (c) of FIG. 2.

The aforementioned axial adjustment movement, with consequent variation/adjustment of the configuration of the emitted light beam, can be accomplished, for example, by means of a screw coupling of the two portions 12 and 14 in such a manner that a relative rotational movement of the parts 12 and 14 about the axis X10 produces a corresponding relative axial movement in the terms shown in FIG. 2.

As far as the choice of the materials is concerned, in various embodiments, a reflector 10 as is shown in the figure can be made for example of plastic material treated (for example by aluminization) on its internal surface so as to become reflecting or else with a metal material such as aluminum subjected to a similar treatment.

In various embodiments, the parts 12 and 14 can also be made of different materials, for example the base portion 12 of plastic material and the portion 14, more exposed to the external environment, of metal material such as aluminum, or vice versa.

In various embodiments, as shown schematically in the appended drawings, the annular portion 14 can have, in an axial plane of the reflector 10 (axial plane is taken to mean a plane passing through the axis X10), a mean radius of curvature greater than the corresponding radius of curvature of the base portion 12.

The fact that mean radii of curvature are referred to takes into account the fact that the surfaces of the reflectors in question can, in various embodiments, have parabolic surfaces or, in any case, a radius of curvature that is variable from region to region.

In various embodiments, the function of the base portion can be to intercept and to reflect the part of the light radiation emitted from the source L having a greater divergence angle with respect to the axis X10, whereas the annular portion 14 can be designed to intercept and to reflect the part of the radiation further inside.

It will furthermore be appreciated that, in some conditions of use, when it is desired to use only the base portion 12 for the function of reflector, it is also possible to remove the annular portion 14 of the reflector.

In various embodiments, the relative displacement of the parts 12 and 14 with respect to the axis X10 may be accomplished with means that are different from the screw coupling previously described, which turns out to be particularly suited to individual reflectors 10.

In other embodiments such a coupling of the telescopic type can be formed simply with slider guide surfaces.

FIGS. 3 to 6 illustrate embodiments in which a plurality of reflectors 10 and a corresponding plurality of light sources L are connected together in an array comprising, for example, six reflectors designed to serve six light sources.

Figure 3:
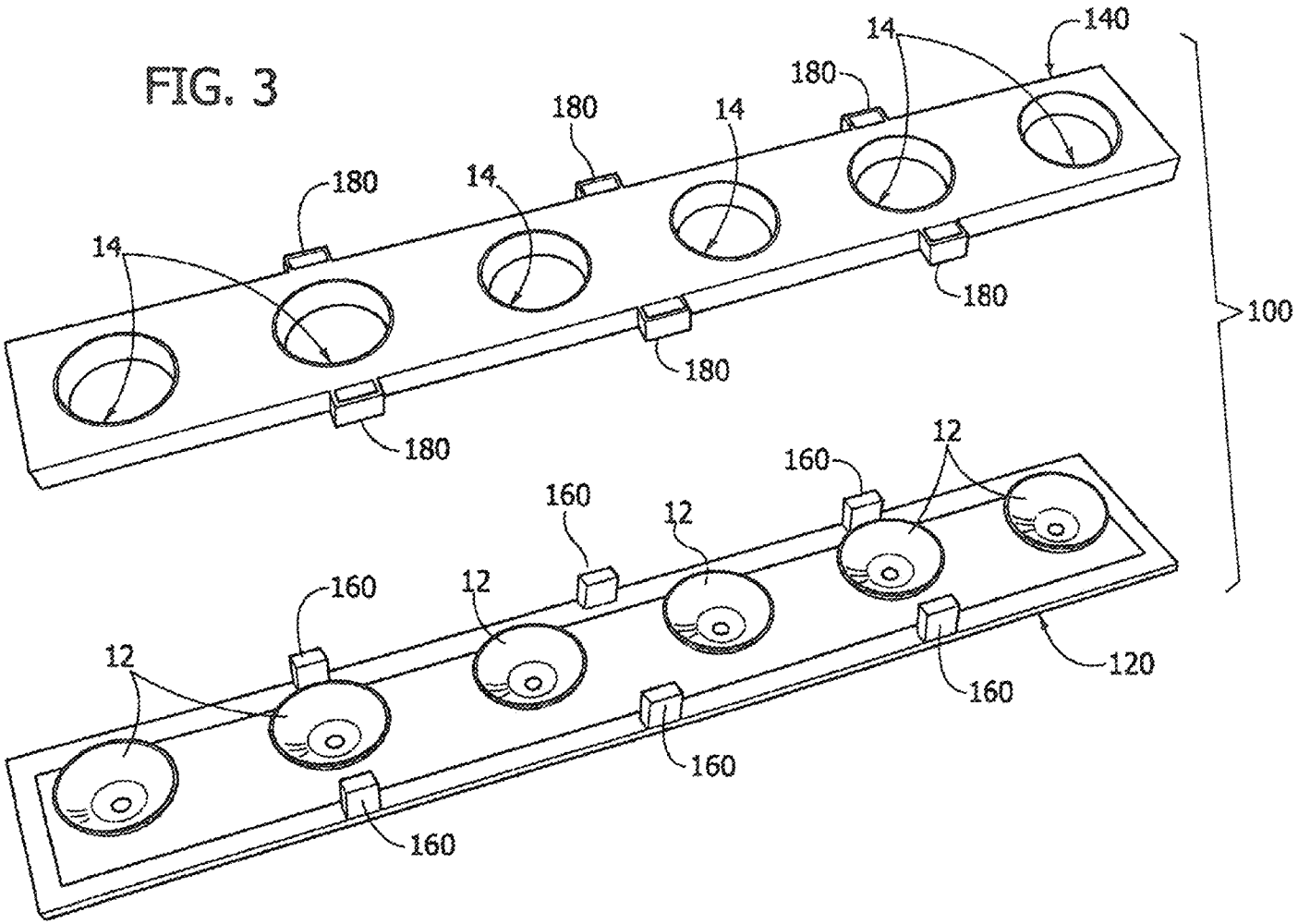
FIG. 3 is a perspective exploded view of an embodiment.
Figure 4:
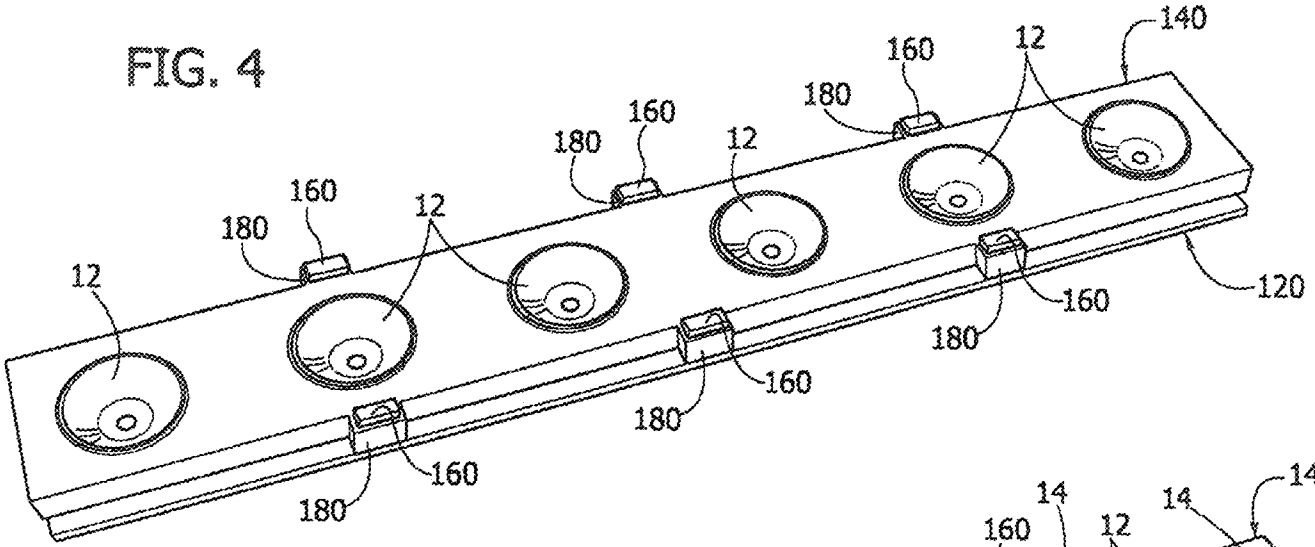
FIG. 4 is a perspective view of an embodiment.
Figure 5:
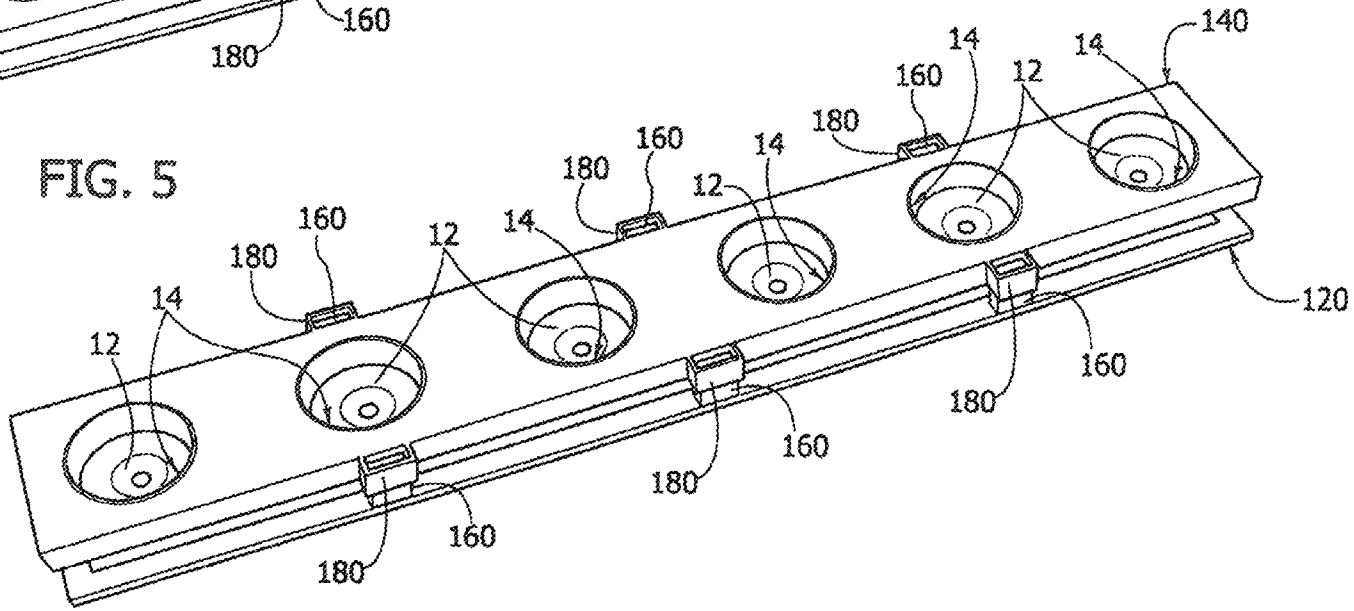
FIG. 5 is a perspective view of a still further embodiment.

In the exemplary embodiment to which FIGS. 3 to 5 refer, the array is a rectilinear array.

In various embodiments, the aforementioned array may comprise a number of sources/reflectors different from six, such a value clearly being purely exemplary in nature.

In various embodiments, the array can be an array different from a rectilinear array also here presented purely by way of example.

In various embodiments, such an array can, for example, be a matrix array, a circular array, etc.

The solution considered here is applicable whatever the number of sources/reflectors and the path along which the reflectors of the array are distributed.

In various embodiments, the base portions 12, on the one hand, and the annular portions 14, on the other hand, of a plurality of reflectors can be coupled within the framework of a structure 100 comprising a support structure 120 that carries the base portions 12 of the reflectors included in the array, and a member that may be defined as a frame element that carries the annular parts 14 of the same reflectors.

In various embodiments, the two parts 120 and 140 (which may, for example, be made of molded plastic material or of metal material, or else one of plastic material and the other of metal material) are coupled together in such a manner that the base portions 12 of the various reflectors are aligned with the corresponding annular parts 14, and the structures 120 and 140, which in the example considered here generally have a plate-like structure, may be moved closer together or further apart as shown schematically in FIG. 4 and in FIG. 5.

In particular, FIG. 4 makes reference to a condition in which the member 140 is completely up against the support structure 120, for which the base portions 12 and the annular parts 14 are located in a relative position substantially corresponding to that shown (with reference to the single reflector) in the part (a) of FIG. 2.

FIG. 5, on the other hand, shows a condition in which the member 140 is in a condition of (maximum) separation from the support structure 120, for which the base portions 12 and the annular parts 14 are located in the relative position shown (again with reference to a single reflector 10) in the part (c) in FIG. 2.

The aforementioned coupling configuration under conditions of relative centering and with a capacity for relative movement closer together and further apart (a movement which of course can be carried out through the continuum of intermediate positions included between the end positions shown in FIG. 4 and in FIG. 5) can be accomplished, for example, by providing on one of the parts 120 and 140 tab formations 160 capable of engaging in corresponding receiving holes 180 (for example of rectangular shape) provided along the periphery of the other part.

In the example illustrated here (which is as such), the formations 160 protrude upward with respect to the plate-like body of the structure 120 so as to able to engage in corresponding receiving holes 180 provided along the periphery of the body of the member 140.

In various embodiments, the coupling between the tabs 160 and the receiving holes 180 can be carried out (for example by providing an elastic preloading in the tabs 160 directed toward the outside or toward the inside) in a manner such that they are also mutually translatable nearer together and further apart, the two parts 120 and 140—once held in a given relative position—maintaining the corresponding distance in as much as the relative slippage of the tabs 160 and of the receiving holes 120 is prevented by a friction effect with elastic preloading. Such a result can be enhanced by operating in various ways, for example by providing on the surface of the tabs 160 a certain level of surface roughness such as with milling or ridging.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device comprising:

an array of reflectors, each of said reflectors comprising:

a cup-shaped base portion centered around a main axis the base portion extending from a bottom opening adapted to admit a source of light radiation, to an outer rim, and an annular portion surrounding said outer rim, said annular portion being telescopically coupled to said base portion and moveable with respect to said base portion along said main axis in order to vary the length over which said annular portion extends along said main axis with respect to said outer rim of said base portion;

a support structure carrying one or more of said base portions of said reflectors in the array, and a frame member carrying one or more of said annular portions of said reflectors in the array.

2. The device as claimed in claim 1, wherein said frame member is adjustable towards and away from said support structure in order to vary a length over which said annular portions of the reflectors in the array extend with respect to one or more of the outer rims of the base portions of the reflectors in the array.

* * * * *